US007455338B2

(12) United States Patent
Jenney

(10) Patent No.: US 7,455,338 B2
(45) Date of Patent: Nov. 25, 2008

(54) LEVELING DEVICE FOR LIFTING APPARATUS AND ASSOCIATED METHODS

(76) Inventor: Alfred P. Jenney, 23081 Snapper Land, Cudjoe Key, FL (US) 33042

( * ) Notice: Subject to any disclaimer, the term of this patent is extended or adjusted under 35 U.S.C. 154(b) by 276 days.

(21) Appl. No.: 11/246,393

(22) Filed: Oct. 7, 2005

(65) Prior Publication Data

US 2007/0080549 A1 Apr. 12, 2007

(51) Int. Cl.
*B66C 1/10* (2006.01)

(52) U.S. Cl. ..... 294/81.3; 294/81.4; 294/67.5; 294/905; 294/907

(58) Field of Classification Search ..... 294/67.21, 294/67.5, 81.3, 81.4, 86.41, 905, 907
See application file for complete search history.

(56) References Cited

U.S. PATENT DOCUMENTS

| | | | | | |
|---|---|---|---|---|---|
| 1,128,277 | A | | 2/1915 | Adler | |
| 1,862,081 | A | * | 6/1932 | Grant | 294/67.21 |
| 2,514,307 | A | * | 7/1950 | Boyd | 294/67.21 |
| 2,822,210 | A | | 2/1958 | Gebhart | 294/109 |
| 2,958,557 | A | | 11/1960 | Cianchette | 294/106 |
| 2,983,542 | A | | 5/1961 | Shull | 294/78 |
| 3,164,406 | A | | 1/1965 | Barry | 294/88 |
| 3,208,789 | A | | 9/1965 | Barry | 294/110 |
| 3,306,646 | A | | 2/1967 | Flora, Jr. | 294/2 |
| 3,404,911 | A | | 10/1968 | Burnett | 294/81 |
| 3,455,593 | A | | 7/1969 | Moro | 294/110 |
| 3,596,968 | A | * | 8/1971 | Holm | 294/81.3 |
| 3,709,548 | A | | 1/1973 | Hogshead | 294/74 |
| 3,718,362 | A | | 2/1973 | Butz | 294/112 |
| 3,741,600 | A | | 6/1973 | Crook, Jr. | 294/82 |
| 3,942,834 | A | | 3/1976 | Kawaguchi | 294/110 |
| 4,035,010 | A | | 7/1977 | Kawashita et al. | 294/81 |
| 4,371,203 | A | | 2/1983 | Munro | 294/83 |
| 4,402,541 | A | | 9/1983 | Bomberger et al. | 294/81 |
| 4,422,683 | A | * | 12/1983 | Charonnat | 294/81.3 |
| 4,762,355 | A | | 8/1988 | Hogg | 294/82.12 |
| 4,938,517 | A | | 7/1990 | Langloy | 294/101 |
| 4,973,094 | A | * | 11/1990 | Tana et al. | 294/81.21 |
| 5,037,151 | A | | 8/1991 | Kameyama et al. | 294/81.55 |
| 5,240,298 | A | | 8/1993 | Teaby et al. | 294/81.4 |
| 5,617,964 | A | * | 4/1997 | Lucking et al. | 212/327 |
| 6,048,012 | A | * | 4/2000 | Selby et al. | 294/81.3 |
| 6,062,620 | A | | 5/2000 | Walker et al. | 294/67.31 |
| 6,209,938 | B1 | | 4/2001 | James, Jr. | 294/86.41 |
| 6,357,810 | B1 | | 3/2002 | Schwulst | 294/81.3 |
| 6,601,892 | B2 | | 8/2003 | Scarborough | 294/103.1 |

FOREIGN PATENT DOCUMENTS

| | | |
|---|---|---|
| DE | 3430468 | 2/1986 |
| GB | 2063210 | 6/1981 |

* cited by examiner

*Primary Examiner*—Dean J Kramer
(74) *Attorney, Agent, or Firm*—Mark R. Malek, Esq.; Zies Widerman Sutch & Malek

(57) ABSTRACT

A leveling device for a lifting apparatus having a load-carrying member includes a level arm-carrying member and a pair of leveling arms having a first end pivotally connected thereto that are independently moveable between extended and retracted positions. The leveling device also includes a level sensor carried by the load-carrying member, and a controller in communication with the level sensor. The controller moves the leveling arms between the extended and retracted positions responsive to the level sensor sensing the load-carrying member being out of level.

20 Claims, 15 Drawing Sheets

LEVELING DEVICE FOR LIFTING APPARATUS AND ASSOCIATED METHODS

FIELD OF THE INVENTION

The present invention relates to the field of cranes and hoists and, more particularly, to the field of moving and leveling loads using cranes and hoists, and related methods.

BACKGROUND OF THE INVENTION

Material loads, such as structural steel, for example, may be delivered to warehouses for processing on flatbed trucks. After the material load is offloaded, there may be a need to move the materials between various parts of the warehouse for different types of processing. For example, in the case of processing structural steel, one area of the warehouse may be used for drilling, and another area of the warehouse may be used for welding. Accordingly, there may be a need to move the structural steel members between various areas of the warehouse.

Currently, structural steel members may be moved by wrapping a pair of chains around portions of the structural steel member, and connecting an end of the chains to a hoist. This system, however, requires that the center of gravity of the structural steel members be located before lifting the load. If the structural steel member is lifted off-center, the structural steel member will not be level. Accordingly, if the structural steel member is not level, a danger exists that the structural steel member may slide out of the chains and drop from its lifted position. Therefore, upon discovering that the structural steel member is lifted out of level, an operator of a hoist lowers the structural steel member and moves the position of the chains in an attempt to lift the structural steel member in a level position. This process is generally repeated until the center of gravity is located. Use of such a system may be time consuming.

U.S. Pat. No. 3,942,834 to Kawaguchi discloses a lifting device for lifting structural steel members. The lifting device includes a pair of opposing grappling arms that are pivotally connected to support plates. More specifically, the weight of the body of the lifting device causes the lifting arms to initially be in an extended position. As the lifting device is lowered, a structural steel contact member engages the top of a flange of the structural steel member to pivot the grappling arms inwardly so that the structural steel member may be lifted. After the structural steel member is lifted using the Kawaguchi '834 lifting device, however, the structural steel member may not be level. Accordingly, it may be necessary to lower the grappling arms, disengage the grappling arms from the structural steel member and re-position the grappling arms along the structural steel member so that the structural steel member may be lifted and moved in a level position. Again, this process may be time consuming.

U.S. Pat. No. 3,455,593 to Moro discloses a lifting device including a pair of opposing lifting tongs. Each lifting tong includes a pair of opposing grappling arms that may be moved between engaged and disengaged positions responsive to movement of a hinged plate. More specifically, the hinged plate engages a plate guide, and is moved between a locked and an unlocked position within a plate guide. The Moro '593 lifting device requires that the grappling arms be moved to a disengaged position before engaging the object to be lifted. Accordingly, use of the lifting device may also be time consuming, and may require additional labor to lift and move a material load.

U.S. Pat. No. 3,709,548 to Hogshead discloses a leveling sling for carrying and leveling an elongate load. The sling includes a pulley system through which a plurality of cables may be passed so that the cable length may be readily adjusted to level the elongate load. More specifically, the leveling sling requires an initial adjustment of the cables to roughly level the load before it is lifted, and a small adjustment of the cables after the load has been lifted to thereby level the load after it has been lifted.

U.S. Pat. No. 5,037,151 to Kameyama et al. discloses a lifting device including a pair of opposing actuators that may be operated pneumatically, hydraulically or electrically. More specifically, the lifting device includes a pair of extendable guide arms that connect to a lower portion of an elongate beam. Lifting slings are connected to the ends of the guide arms. The actuators are in communication with a remote controller, which may be used to send a signal to extend and contract the guide arms. Accordingly, each of the opposing guide arms are selectively controlled by remote control so that a user may move the guide arms inwardly or outwardly, thereby adjusting the position of the lifting slings to accommodate various sized loads.

SUMMARY OF THE INVENTION

In view of the foregoing background, it is therefore an object of the present invention to provide a leveling device that levels a load being carried by a lifting apparatus. It is also an object of the present invention to provide a leveling device for a lifting apparatus that senses whether a load being lifted is level and that moves the load into a level position. It is further an object of the present invention to provide a leveling device that allows a load to be readily lifted in a level position so that the load may be moved in an efficient manner.

These and other objects, features, and advantages in accordance with the present invention are provided by a leveling device for use with a lifting apparatus including a load-carrying member. The leveling device may comprise a level arm-carrying member and a pair of leveling arms pivotally connected thereto. The level arm-carrying member may include a connection member adjacent a top portion thereof for connection to a hoist, or crane, for example.

The leveling arms may have a first end pivotally connected to the level arm-carrying member adjacent a bottom portion thereof, and a second end connected to the load-carrying member. Each leveling arm is preferably independently moveable between extended and retracted positions.

The leveling device may also comprise a level sensor carried by the load-carrying member and in communication with the leveling arms to sense whether the load-carrying member is level. The leveling device may further comprise a controller in communication with the level sensor to move the leveling arms between the extended and retracted positions responsive to the level sensor sensing the load-carrying member being out of level.

Accordingly, the leveling device advantageously senses whether a load being carried by the load-carrying member is level. Upon sensing that the load-carrying member is not level, the controller may advantageously cause the load-carrying member to be moved to a level position by moving the leveling arms between the extended and retracted positions.

The pair of leveling arms may be hydraulic leveling arms. Accordingly, the leveling device may also comprise a hydraulic fluid supply reservoir carried by the load-carrying member and in communication with the hydraulic leveling arms. The leveling device may further comprise a power supply in communication with the controller and carried by the load-carrying member.

The level sensor may, for example, be either a fluid level sensor or an electronic level sensor. The fluid level sensor may comprise at least one pair of fluid reservoirs in communication with one another. Accordingly, when a fluid level difference between the pair of opposing fluid reservoirs is sensed, the controller may cause the leveling arms to move between the extended and retracted positions to bring the load into a level position. The fluid level sensor may comprise a switch positioned between the pair of fluid reservoirs and in communication with each fluid reservoir. The switch may be moveable between opened and closed positions, and the controller may cause movement of the leveling arms when the switch is in the closed position.

The leveling device may include a receiver for receiving a signal from a remote controller carried by a user for selectively moving the leveling arms between the extended and retracted positions. The remote controller advantageously allows an operator of the lifting apparatus to move the leveling arms between the extended and retracted positions as desired.

A method aspect of the present invention is for leveling a load being lifted by a lifting apparatus including a load-carrying member. The method may include sensing whether the load-carrying member is level, and extending a leveling arm between extended and retracted positions to bring the load-carrying member into a level position when carrying the load.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
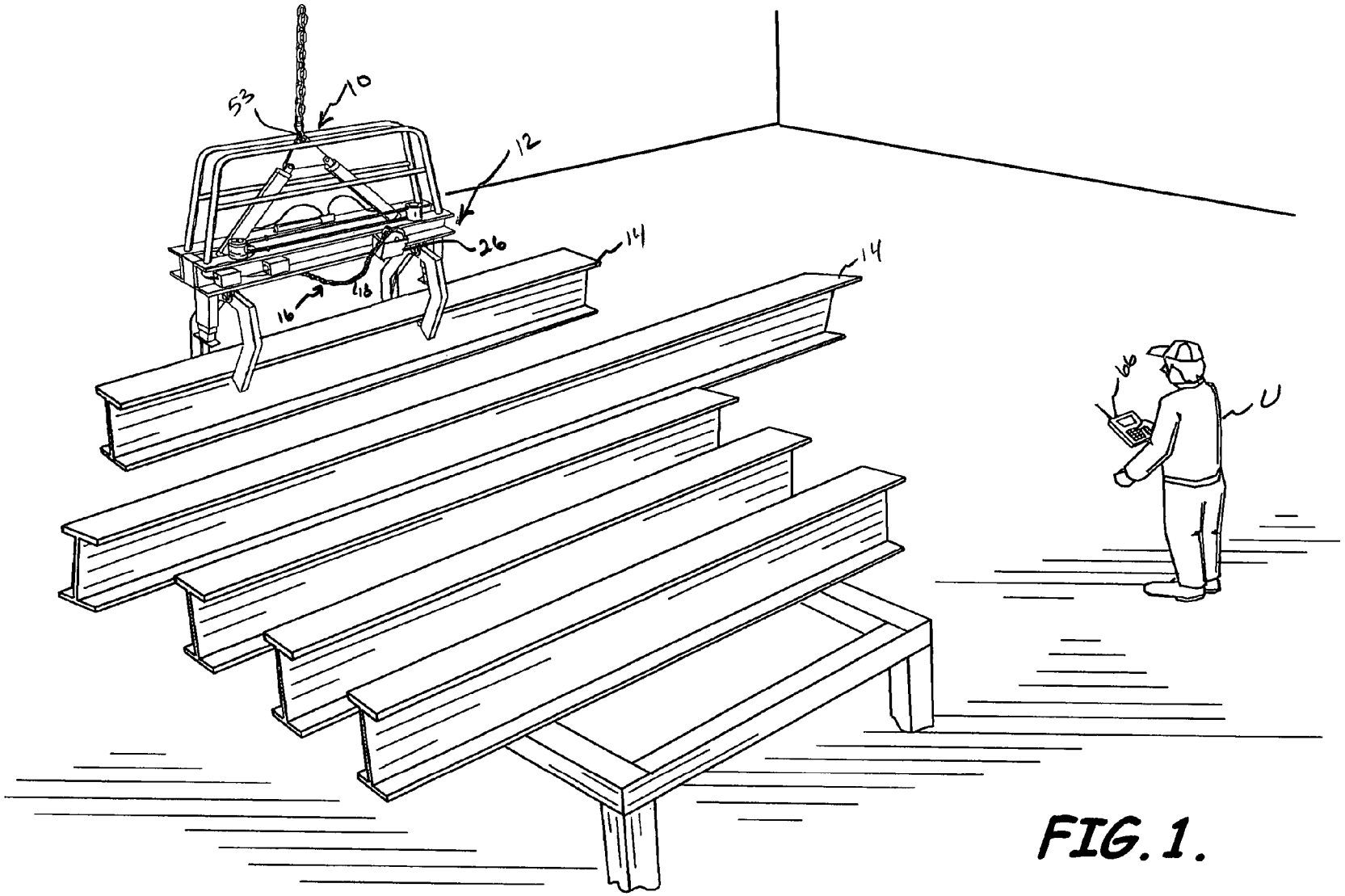
FIG. 1 is a partial environmental view of the leveling device according to the present invention connected to a lifting apparatus including a load-carrying member.

Referring to FIGS. 1-20, a leveling device 10, a lifting apparatus 12 to which the leveling device is connected, and a beam turning device 16 connected to the lifting apparatus are now described. As illustrated in FIG. 1, for example, the leveling device 10 is preferably used with a lifting apparatus 12 so that a load 14 being lifted by the lifting apparatus is preferably lifted in a level position.

As will be described in greater detail below, the beam turning device 16 is preferably used with the lifting apparatus 12 to turn a load 14 being lifted by the lifting apparatus from a horizontal to a vertical position. Of course, the beam turning device 16 may also be used to move the load 14 from a vertical position to a horizontal position, as necessary. Those skilled in the art will also appreciate that, in some instances, the beam turning device 16 may also be used to lift a load 14. More specifically, a pair of beam turning devices 16 may be positioned to engage the load 14 so that the center of gravity of the load is positioned between the beam turning devices.

Figure 20:
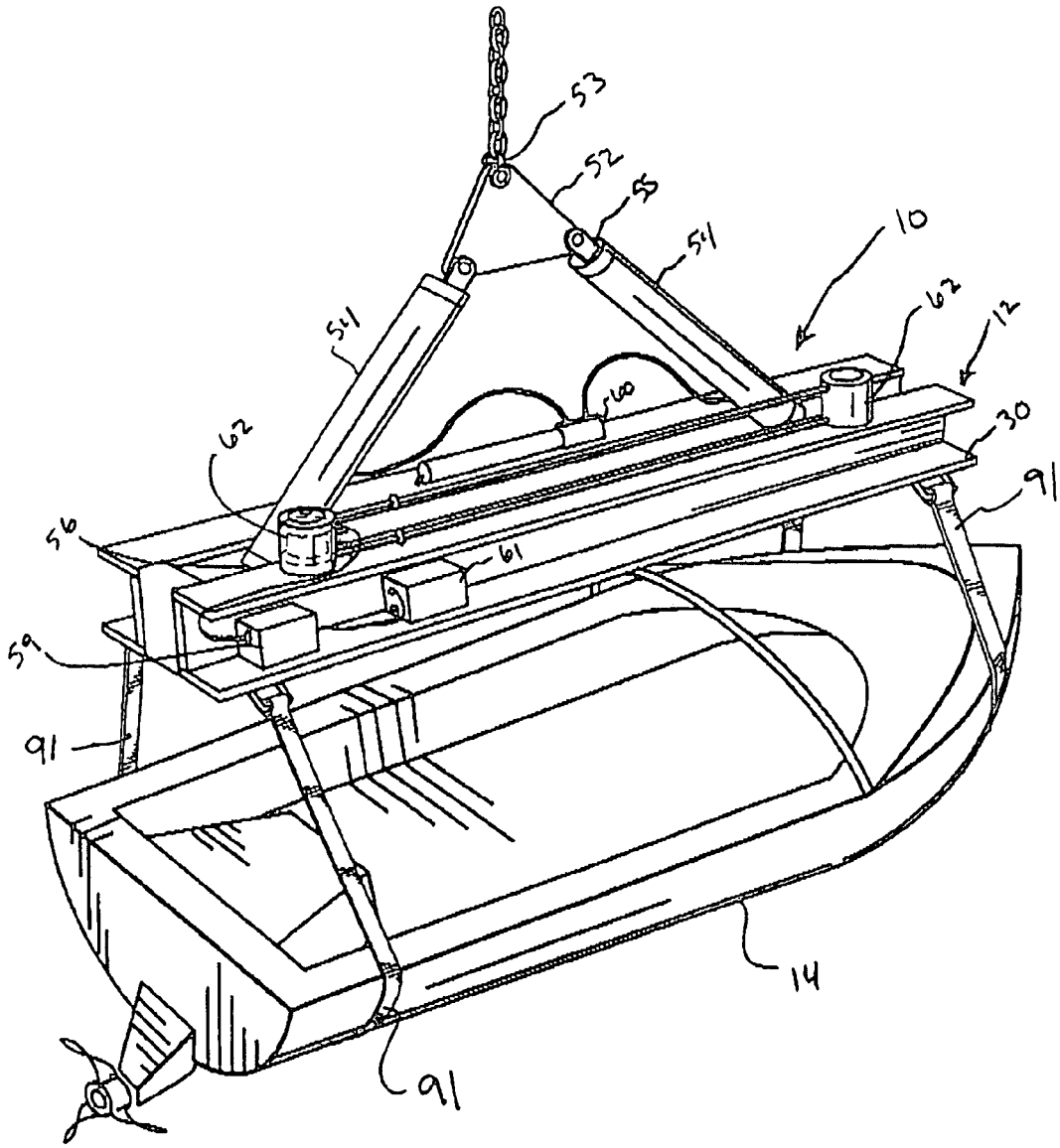
FIG. 20 is a partial environmental view of the leveling device according to the present invention used to carry an object having a shape that is not uniform throughout.

The load 14 illustrated in FIGS. 1-19A is a structural steel member. Those skilled in the art, however, will appreciate that the leveling device 10, and lifting apparatus 12 may be used to lift and level any type of load 14. More specifically, and as illustrated in FIG. 20, the leveling device 10 may be used to level any type of load 14, such as a boat, for example, after it has been lifted. Lifting straps 91 may illustratively be used to engage a bottom portion of the boat. It is preferable, however, that the center of gravity of the boat be positioned between the lifting straps 91. Accordingly, after the boat has been lifted using the lifting straps 91, the leveling device 10 may be used to bring the boat into a level position, if necessary.

Figure 2:
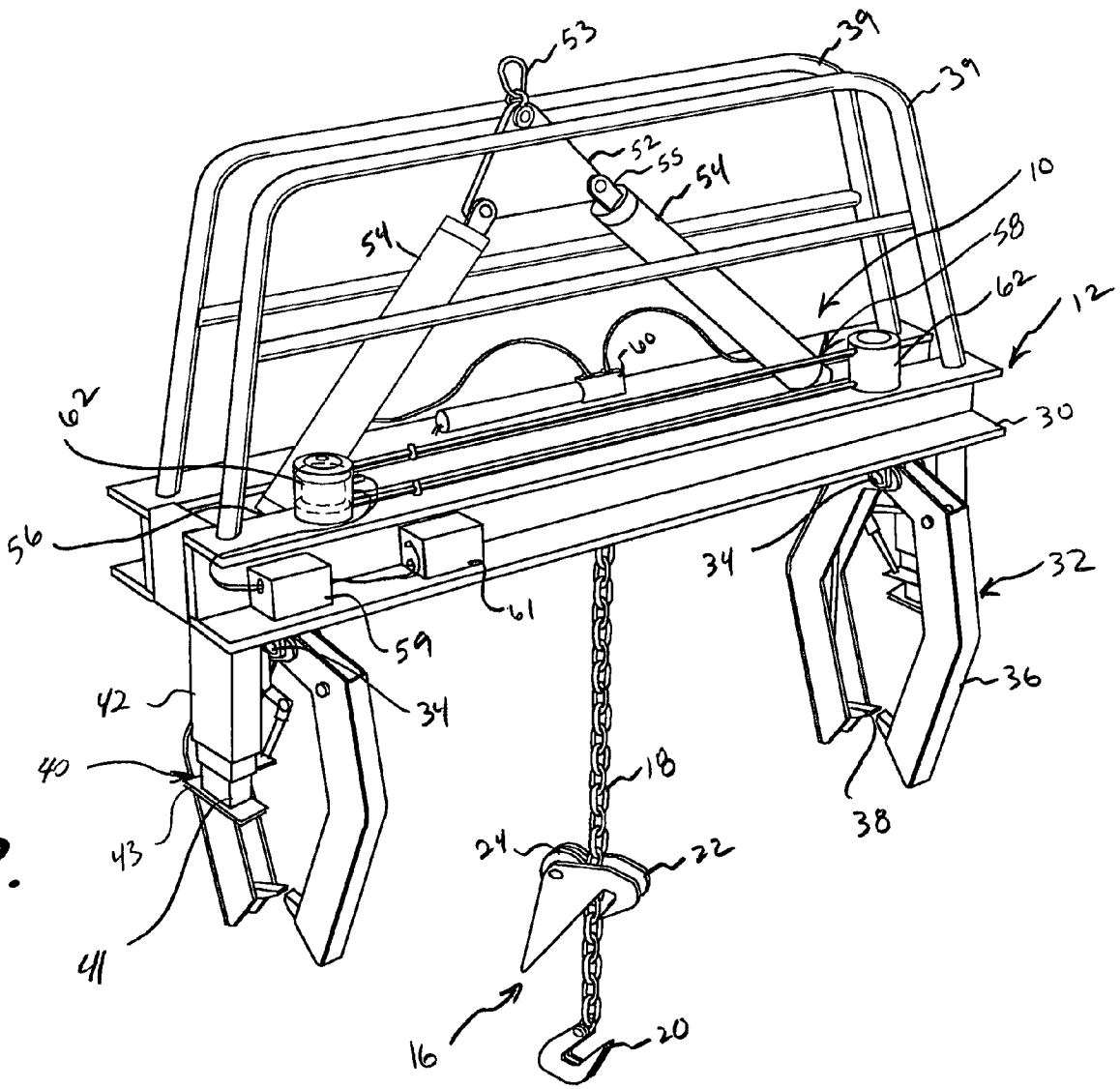
FIG. 2 is a front perspective view of the leveling device illustrated in FIG. 1 connected to a lifting apparatus including a load-carrying member and having a beam turning device connected thereto.
Figure 4:
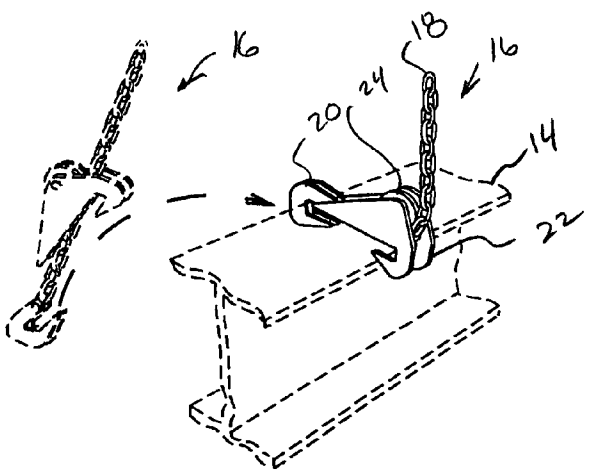
FIG. 4 is partial perspective view of the beam turning device illustrated in FIG. 3 being removed from the structural steel member after the structural steel member has been moved from the horizontal position to the vertical position.
Figure 3:
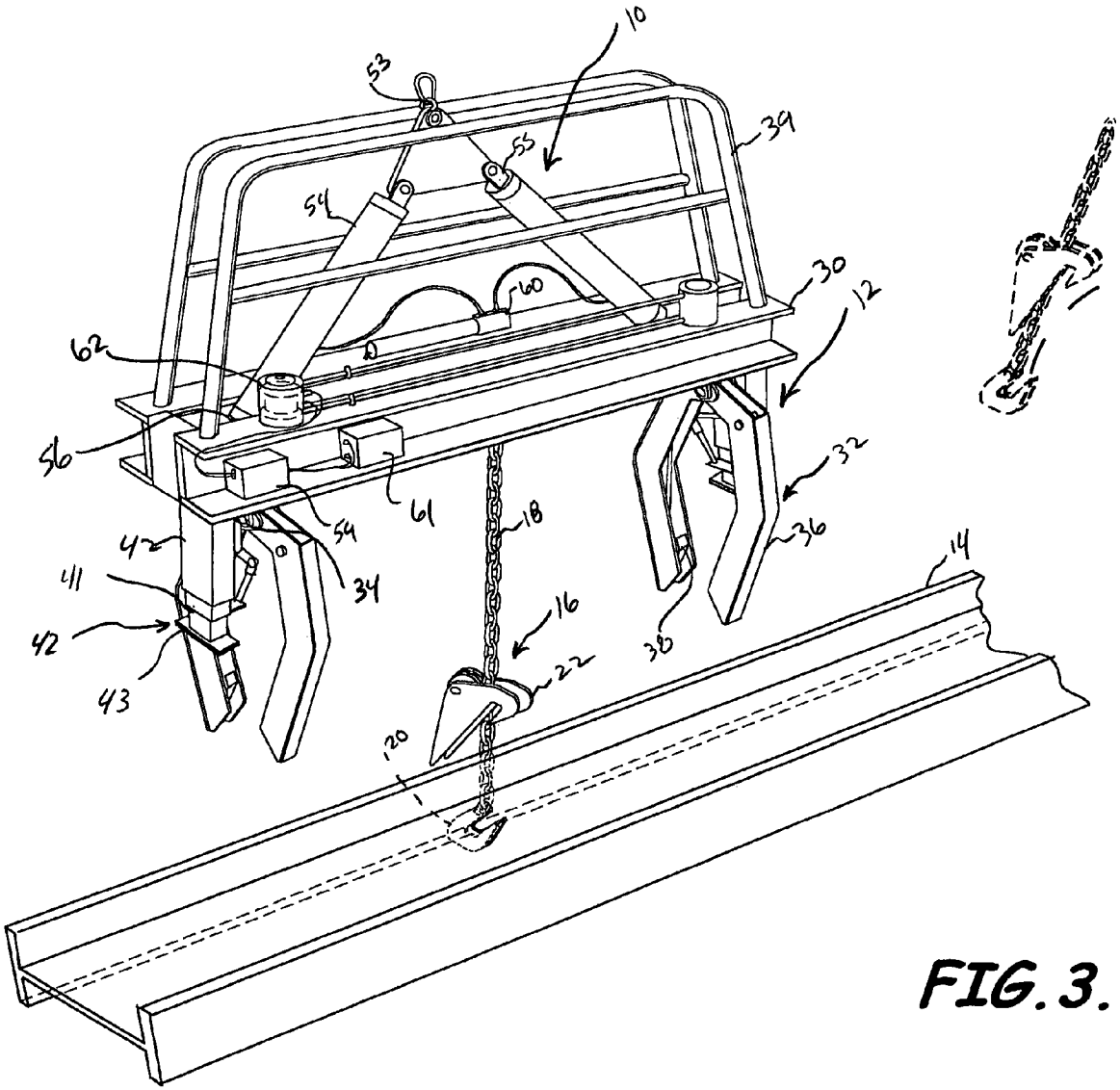
FIG. 3 is a partial front perspective view of the leveling device illustrated in FIG. 1 connected to a lifting apparatus, and showing a beam turning device connected to the lifting apparatus moving a structural steel member between horizontal and vertical positions.
Figure 5:
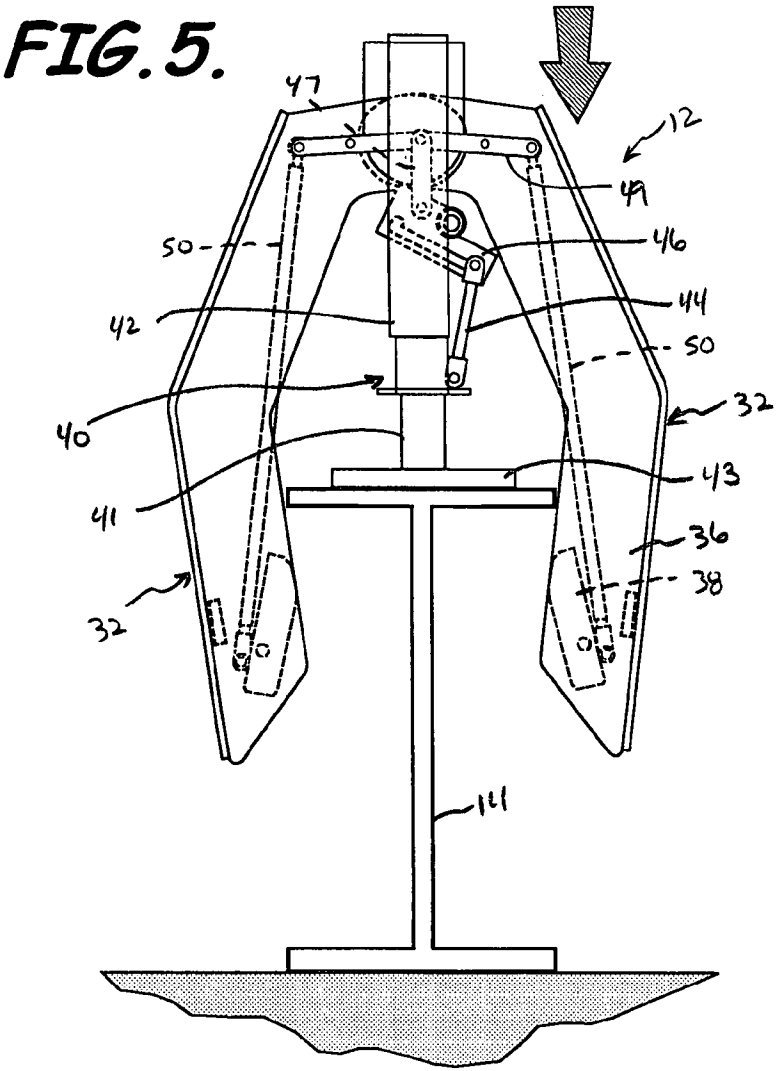
FIG. 5 is a partial side elevational view of the lifting apparatus illustrated in FIG. 2 being positioned over a flange of a structural steel member.
Figure 6:
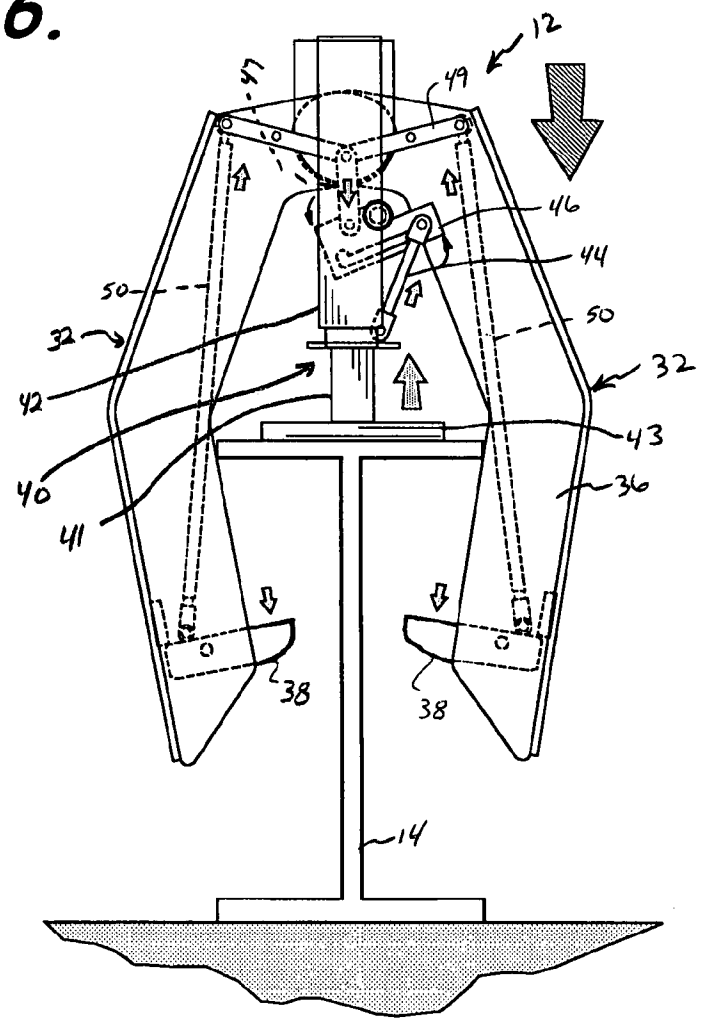
FIG. 6 is a partial side elevational view of the lifting apparatus illustrated in FIG. 5 and illustrating contact members of the lifting apparatus being moved from disengaged to engaged positions.
Figure 7:
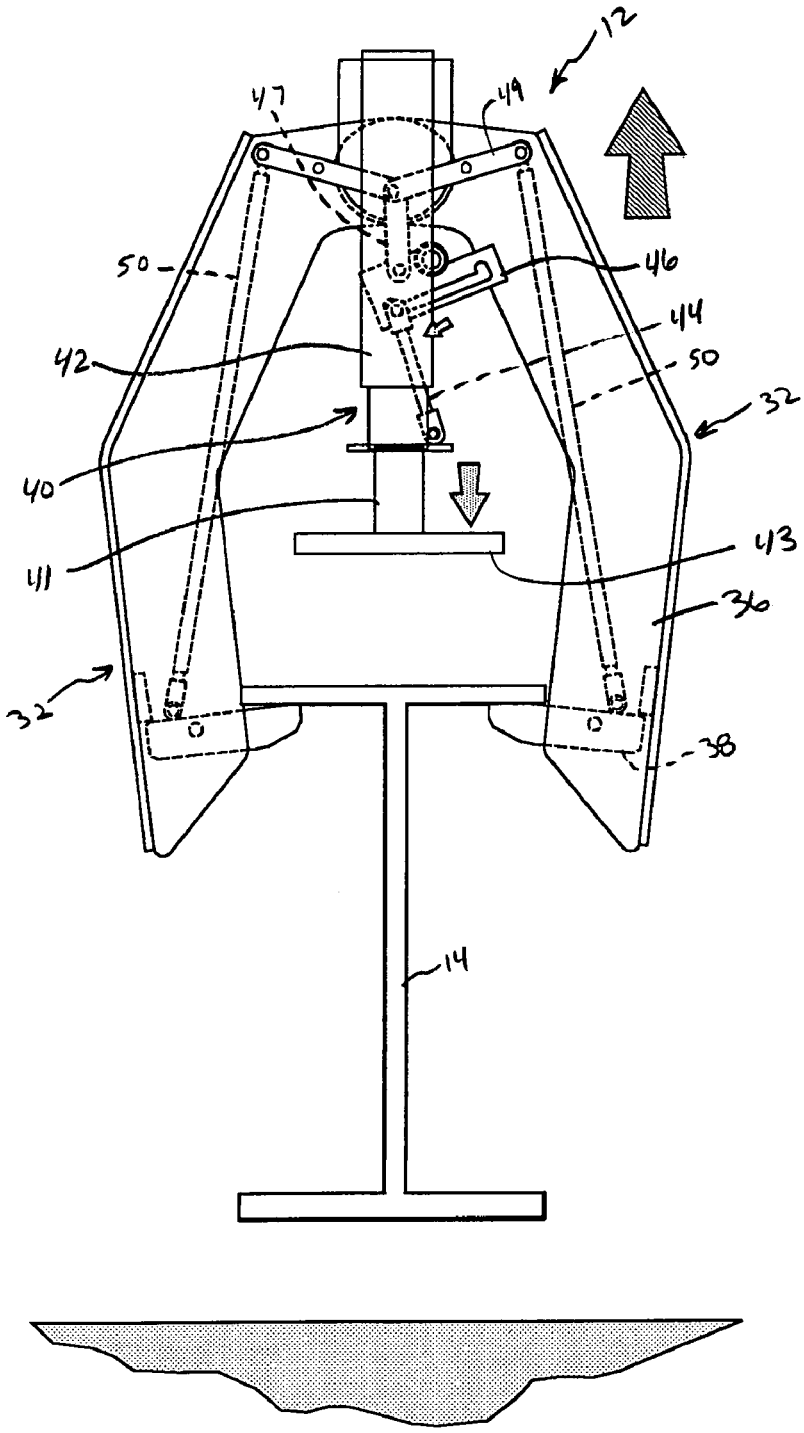
FIG. 7 is a partial side elevational view of the lifting apparatus illustrated in FIG. 6 after the structural steel member has been picked up.

Referring now more specifically to FIGS. 2-4, use of the beam turning device 16 is now described in greater detail. As perhaps best illustrated in FIGS. 3 and 4, the beam turning device 16 may be used to move a structural steel member 14 from a horizontal position to a vertical position.

More specifically, structural steel members 14 are generally delivered to a processing facility in a horizontally stacked formation. The structural steel members 14 may thereafter be moved from the horizontal position (as illustrated in FIG. 3) to a vertical position (as illustrated in FIG. 4). The beam turning device 16 is preferably used to turn the structural steel member 14 from the horizontal position to the vertical position so that the structural steel member may be further processed.

The beam turning device 16 illustratively includes a chain 18 for connection to a bottom portion of the lifting apparatus 12. More specifically, the lifting apparatus 12 may include a connection member (not shown) for connection of the beam turning device 16 thereto.

The beam turning device 16 may also include a lower hook member 20 pivotally connected to a lower portion of the chain 18. The connection between the lower hook member 20 and the chain 18 may be a bolt connection, for example, or any other similar connection as understood by those skilled in the art. The beam turning device 16 also illustratively includes an upper hook member 22 slidably connected to the chain 18. A roller member 24 is preferably carried by a medial portion of the upper hook member 22 so that the upper hook member may slide along the chain 18 when engaged therewith. This advantageously allows the beam turning device 16 to be used with various size loads 14, i.e., structural steel having various flange sizes.

As perhaps best illustrated in FIG. 3, when a structural steel member 14 is in a horizontal position, the lower hook member 20 may be positioned beneath a lower portion of the structural steel member flange. More specifically, the structural steel member 14 may, for example, be positioned in such a manner so that a lower portion of the flange of the structural steel member is elevated from the surface, thereby providing space beneath the flange of the structural steel member so that the lower hook member 20 may be positioned thereunder. This may be accomplished by positioning the structural steel member 14 atop a block of wood, or any other similar article, when the structural steel members are off loaded at the processing facility.

The upper hook member 22 may be slidably lowered to engage an upper portion of the flange of the structural steel member 14. The beam turning device 16 may thereafter be raised so that the structural steel member 14 may be moved from the horizontal position to the vertical position, as perhaps best illustrated in FIG. 4, for example. When the beam turning device 16 is raised, it is preferable for the chain 18, the lower hook member 20 and the upper hook member 22 to be aligned with the center of gravity of the load 14. This is true when the beam turning device 16 is used to move the structural steel member 14 either from the horizontal position to the vertical position or from the vertical position to the horizontal position. To raise the beam turning device 16, the lifting apparatus 12, which is connected to a crane, may be raised.

Figure 8:
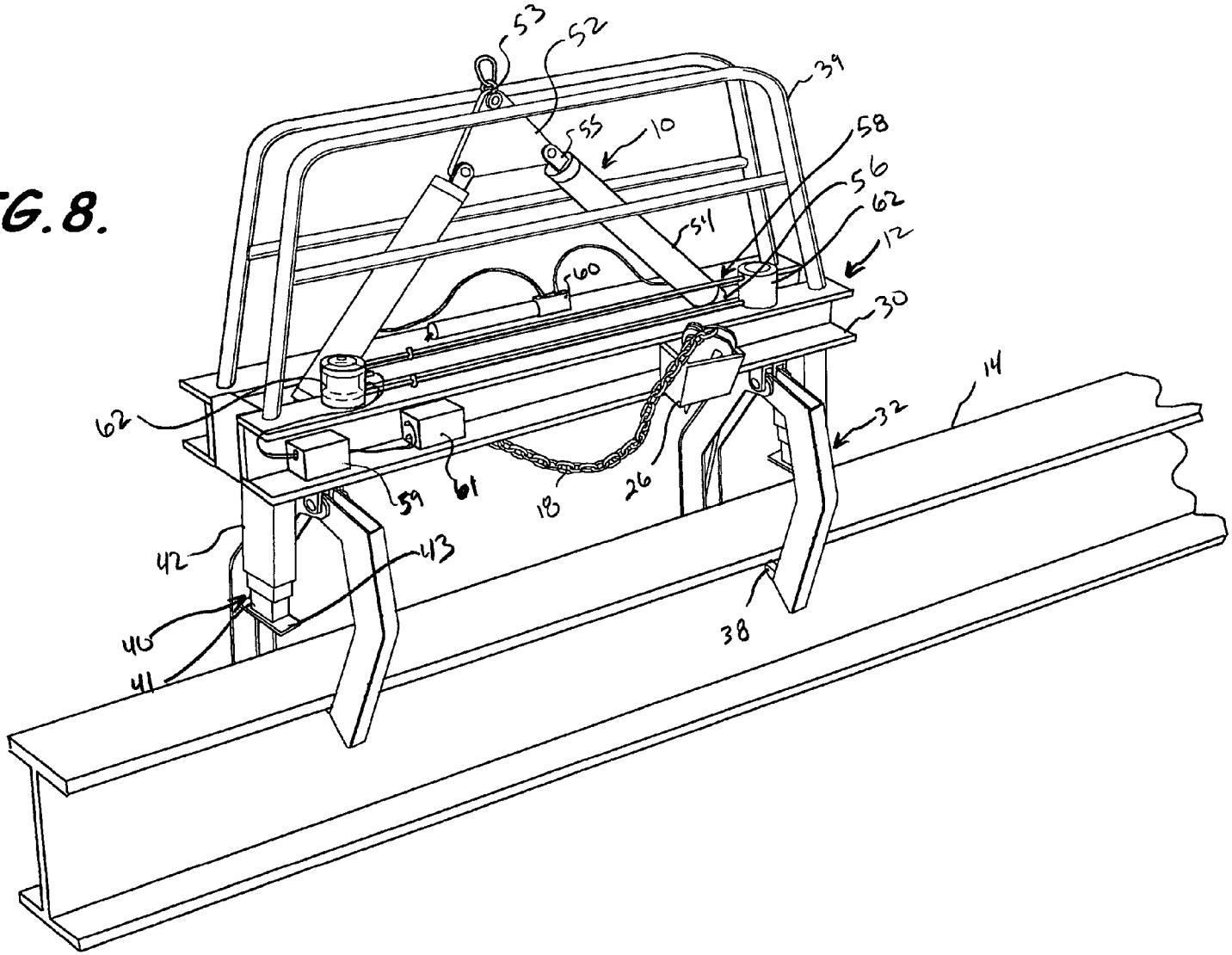
FIG. 8 is a partial perspective view of the lifting apparatus illustrated in FIG. 6 after the structural steel member has been picked up and showing the beam turning device positioned in the holster when not in use.
Figure 10:
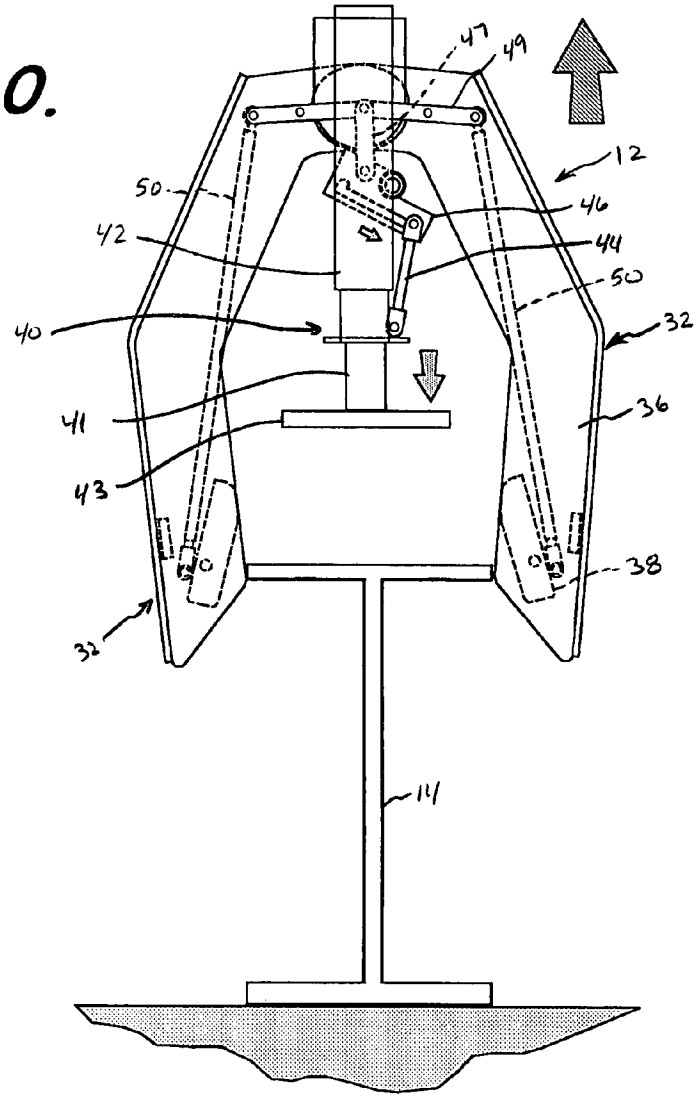
FIG. 10 is a side elevational view of the lifting apparatus illustrated in FIG. 9 and showing the lifting apparatus being raised to disengage the structural steel member.
Figure 9:
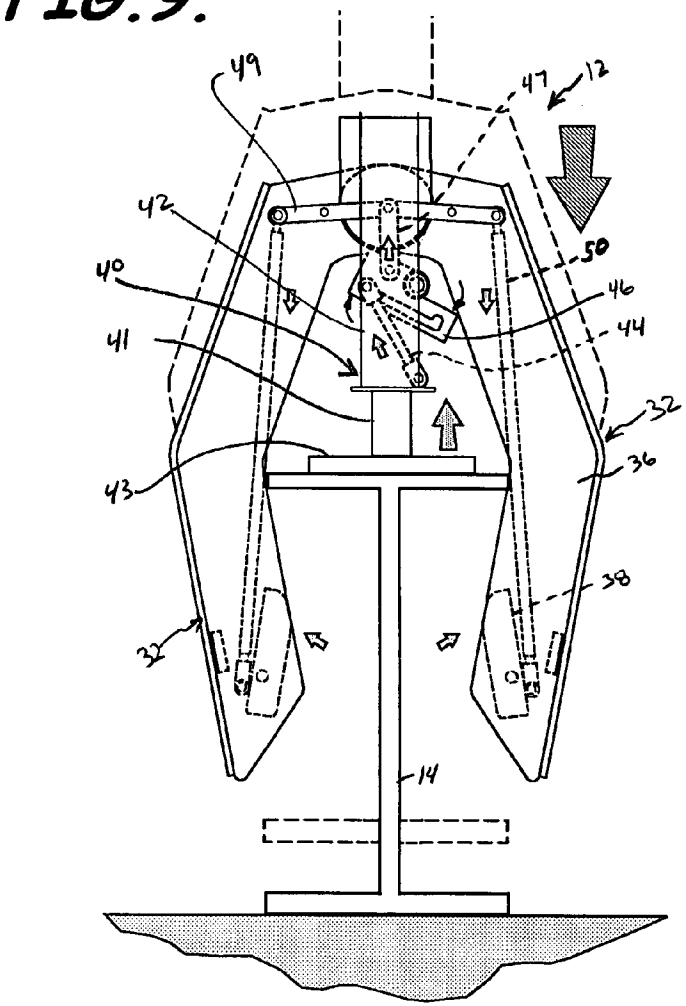
FIG. 9 is a partial side elevational view of the lifting apparatus illustrated in FIG. 6 and showing the contact members in the disengaged position.
Figure 11:
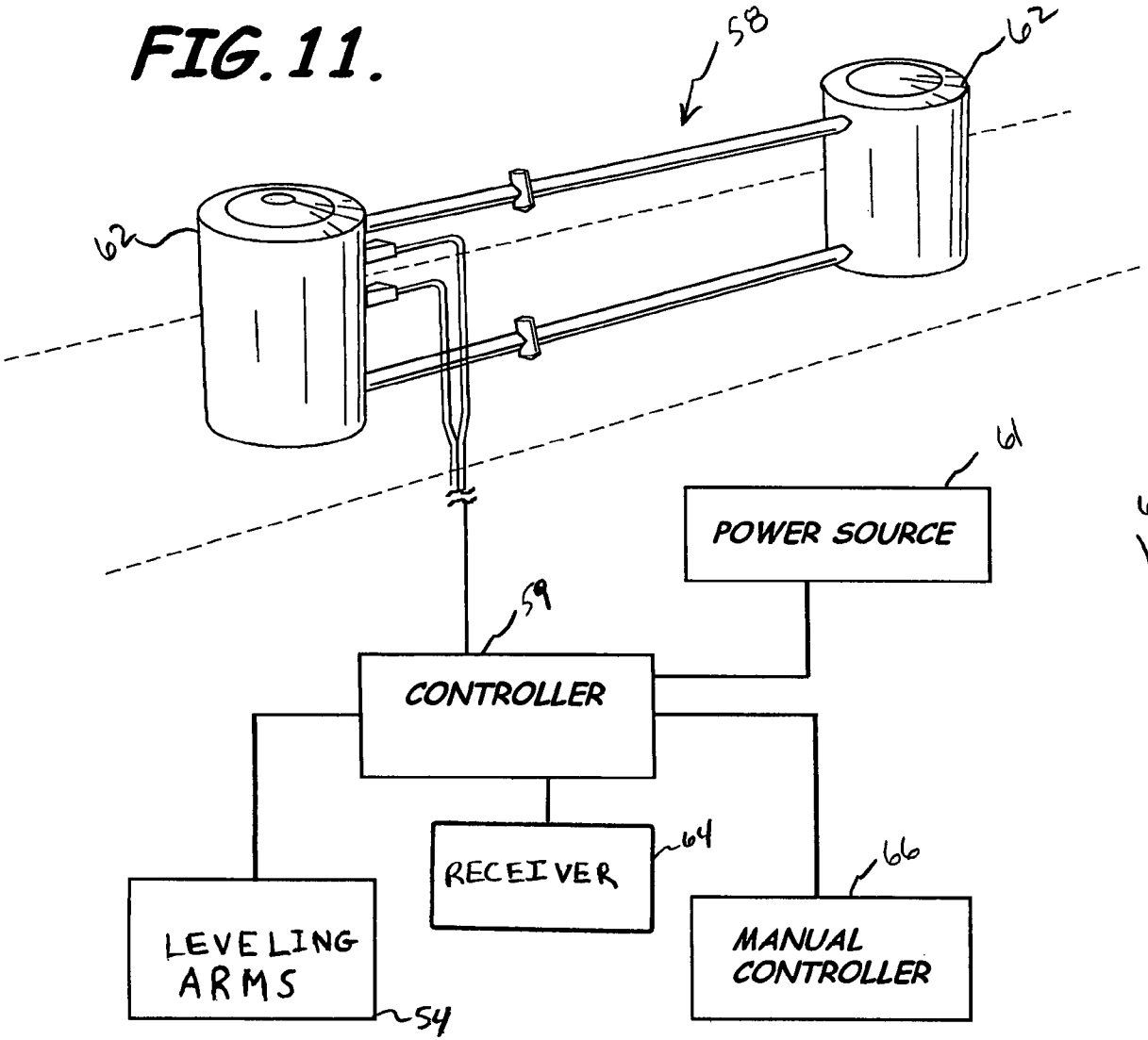
FIG. 11 is a schematic view of a level sensor of a leveling device according to the present invention.
Figure 12:
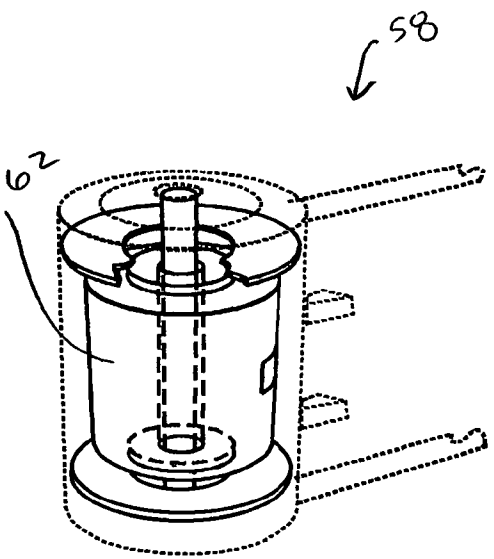
FIG. 12 is a partial perspective view of a fluid reservoir of the level sensor illustrated in FIG. 11.

Referring now briefly to FIG. 8, additional aspects of the beam turning device 16 are now described. The beam turning device 16 may also include a holster 26 for storage of the lower hook member 20, upper hook member 22 and portions of the chain 18 when the beam turning device is not in use. The holster 26 may be carried by the lifting apparatus 12. More specifically, the holster 26 may be made of a metal material, and may be welded to a portion of the lifting apparatus 12. Those skilled in the art, however, will appreciate that the holster 26 may be made of any other type of material suitable for supporting the beam turning device, and may be connected to the lifting apparatus 12 in any other manner.

Referring now additional to FIGS. 5-10, the lifting apparatus 12 is now described in greater detail. The lifting apparatus 12 illustratively includes an elongate load-carrying member 30. When using the lifting apparatus 12 without the leveling device 10, the elongate load-carrying member 30 may include a connection member (not shown) for connection to a crane. The connection member may extend upwardly from a top portion of the load-carrying member 30. The connection member may, for example, be a steel eye, or any other similar connection member as understood by those skilled in the art. Further, the connection member may be welded to a top portion of the load-carrying member 30, but those skilled in the art will also appreciate that the connection member may be connected to the load-carrying member in any other manner.

The lifting apparatus 12 may also include a pair of opposing grip members 32 connected to a bottom portion of the load-carrying member 30. More specifically, each of the opposing grip members 32 may be carried by a grip connection member 34 connected to and extending downwardly from a bottom portion of the load-carrying member 30.

Each grip member 32 may include a pair of hinged arms 36 pivotally connected to the grip connection member 34. Each of the hinged arms 36 are preferably angled. The grip members 32 may be moved between an opened position and a closed position so that when in the opened position, the grip members may be readily positioned over the flange of the structural steel member 14.

Each of the hinged arms 36 preferably includes a contact member 38 adjacent a bottom portion thereof. Each contact member 38 may be moved between an engaged position and a disengaged position. More specifically, and as perhaps best illustrated in FIG. 5, each contact member 38 may initially be positioned in a disengaged position so that the grip members 32 may be positioned over a flange of a structural steel member 14. Thereafter, and as perhaps best illustrated in FIGS. 6 and 7, each contact member 38 may be moved to the engaged position to thereby engage a bottom portion of a flange of the structural steel member 14 so that the lifting apparatus 12 may lift the structural steel member.

The lifting apparatus 12 also illustratively includes a pivot engagement member 40. The pivot engagement member 40 is longitudinally movable between an engaged position and a disengaged position. More specifically, when the pivot engagement member 40 is moved from the disengaged to the engaged position, the respective contact members 38 are also moved from the disengaged to the engaged position. The pivot engagement member 40 may include a tube member 41 and a sleeve member 42. Accordingly, the tube member 41 slidably engages the sleeve member 42.

The pivot engagement member 40 also illustratively includes a plate contact member 43 connected to a bottom portion of the tube member 41. The plate contact member 43 illustratively contacts an upper portion of the flange of the structural steel member 14 to longitudinally move the pivot engagement member 40 between the engaged and disengaged positions.

The lifting apparatus 12 also includes a track engagement rod 44 pivotally connected to the sleeve member 42 of the pivot engagement member 40. More specifically, a bottom portion of the track engagement rod 44 is pivotally connected to the pivot engagement member 40 so that the track engagement rod pivots between engaged and disengaged positions as the pivot engagement member moves from engaged to disengaged positions.

The lifting apparatus 12 also includes a track member 46 pivotally connected to the sleeve member 42 of the pivot engagement member 40, and matingly engaging and upper portion of the track engagement rod 44. The track member is illustratively pivotally connected to the sleeve member 42 and includes a track formed therein that matingly engages the track engagement rod 44 to thereby guide the track engagement rod between the engaged and disengaged positions. A track formed in the track member 46 is preferably an L-shaped track. The track formed in the track member 46 may also be a C-shaped track having opposing up-turned portions. Those skilled in the art will appreciate that the track formed in the track member may have any other shape that allows the track engagement rod 44 to be moved between the engaged and disengaged positions.

The lifting apparatus 12 further illustratively includes a pivot rod engagement member 47 pivotally connected to the track member. More particularly, the pivot rod engagement member 47 is moveable between an engaged and a disengaged position. A pair of opposing pivot engagement rods 49 are illustratively connected to and extend outwardly from the pivot rod engagement member 47. Movement of the pivot rod engagement member 47 between the engaged and disengaged positions causes the pivot engagement rods 49 to move between the respective engaged and disengaged positions.

A pair of opposing contact member rods 50 are pivotally connected to the respective pivot engagement rods 49 and extend downwardly therefrom. The contact member rods 50 are also movably connected to the respective contact members 38 so that movement of the contact member rods 50 between engaged and disengaged positions causes movement of the contact members 38 between the engaged and disengaged positions.

The lifting apparatus 12 may also include a pair of opposing guard members 39 extending upwardly from the load-carrying member 30. The guard members 39 may advantageously provide additional stability to the lifting apparatus. The guard members 39 may be tube steel member, for example, or any other type of similar material, as understood by those skilled in the art. Those skilled in the art will also appreciate that the lifting apparatus 12 may also be provided without the opposing guard members 39, as perhaps best illustrated in FIG. 20.

Operation of the lifting apparatus 12 will now be described in greater detail. Initially, the contact members 38 of the lifting apparatus 12 are positioned in the disengaged position. The lifting apparatus 12 may thereafter be positioned to overlie the flange of the structural steel member 14. The grip members 32 may pass over the flange of the structural steel member 14 so that a bottom portion of the grip members 32 is positioned between the lower and upper flange of the structural steel member. As the plate contact member 43 makes contact with the upper flange of the structural steel member 14, the weight of the lifting apparatus 12 causes the tube member 41 of the pivot engagement member 40 to slidably engage the sleeve member 42 of the pivot engagement member. Thereafter, movement of the pivot engagement member 40 from the disengaged to the engaged positions causes movement of the contact members 38 from the disengaged to the engaged positions as illustrated, for example, in FIG. 6.

The structural steel member 14 may then be lifted by elevating the lifting apparatus 12, which is connected to a crane that causes the lifting apparatus to be selectively moved between elevated and lowered positions. After the structural steel member 14 has been moved to a desired location and lowered, the weight of the lifting apparatus 12 causes the tube member 41 of the pivot engagement member 40 to again slidably engage the sleeve member 42 of the pivot engagement member. Movement of the pivot engagement member 40 from the engaged to the disengaged positions causes movement of the contact members 38 from the engaged to the disengaged positions. After the contact members 38 have been moved to the disengaged positions as illustrated, for example, in FIG. 9, the lifting apparatus 12 may be readily removed from the structural steel member 14.

The lifting apparatus 12 is preferably made of steel material and includes welded connections. Those skilled in the art, however, will appreciate that the lifting apparatus 12 may also be made of any other material having strength properties suitable for lifting various loads, and the associated connections may also be any other type of connections.

Referring now additionally to FIGS. 11-19A a leveling device 10 for use with the lifting apparatus 12 is now described in greater detail. The leveling device 10 illustratively includes a level arm-carrying member 52. The level arm-carrying member 52 includes a connection member 53 adjacent a top portion thereof for connection to a crane. More specifically, the level arm-carrying member 52 may have a triangular shape, and may have a passageway formed therein for receiving the connection member 53. Those skilled in the art, however, will appreciate that the level arm-carrying member 52 may have any shape.

The leveling device 10 also illustratively includes a pair of leveling arms 54 connected thereto. More specifically, the leveling arms 54 each have a first end 55 pivotally connected to a base portion of a level arm-carrying member 52. Accordingly, the level arm-carrying member 52 may also include passageways formed therein for receiving a connection for each of the leveling arms 54. The connection between the level arm-carrying member 52 and the leveling arms 54 may, for example, be a bolt connection passed through passageways formed in the first end 55 of each leveling arm and the level arm-carrying member 52. Those skilled in the art will appreciate, however, that any other connection may be used that allows for pivotal movement between the leveling arms 54 and the level arm-carrying member 52.

Those skilled in the art will appreciate that the leveling device 10 may also include a plurality of leveling arms, i.e., more than two. This advantageously allows for a load 14 to be leveled in all directions, i.e., from front to back and from right to left.

The leveling arms 54 also each include a second end 56 connected to the load-carrying member 30 of the lifting apparatus 12. Each leveling arm 54 is preferably independently moveable between extended and retracted positions. The leveling arms 54 may be connected to the load-carrying member 30 using a bolt connection, for example, passed through passageways formed in both the load-carrying member and the second end 56 of each leveling arm. Those skilled in the art will appreciate that any other connection may be used that allows for pivotal movement between the leveling arms 54 and the load-carrying member 30.

The leveling device 10 also includes a level sensor 58 carried by the load-carrying member 30 of the lifting apparatus 12. The level sensor 58 is in communication with the leveling arms 54 to sense whether the load-carrying member 30 of the lifting apparatus 12 is in a level position. As will be discussed in greater detail below, the level sensor 58 may be a fluid level sensor, an electronic level sensor, or any other type of level sensor, as understood by those skilled in the art. The leveling device 10 also includes a controller 59 in communication with the level sensor 58 to move at least one of the leveling arms 54 between the extended and retracted positions responsive to the level sensor sensing the load-carrying member 30 being out of level.

The leveling arms 54 are preferably hydraulic leveling arms. Accordingly, the leveling device 10 may also include a hydraulic fluid supply reservoir 60 carried by the load-carrying member 30 of the lifting apparatus 12. The hydraulic fluid supply reservoir 60 is preferably positioned between and in communication with the hydraulic leveling arms 54. More specifically, the hydraulic fluid supply reservoir 60 is common to both hydraulic leveling arms 54. A compressed air supply (not shown) may also be provided and positioned in communication with the hydraulic fluid supply reservoir 60 to push the hydraulic fluid from the hydraulic fluid supply reservoir to one of the leveling arms 54 to thereby extend the respective leveling arm.

Those skilled in the art will appreciate that the flow of the hydraulic fluid between the hydraulic fluid supply reservoir 60 and the leveling arms 54 is accomplished using a closed system. When it becomes necessary to move a leveling arm 54 from an extended position to a retracted position, compressed air that was previously introduced into the hydraulic fluid supply reservoir 60 from the compressed air supply is returned to the compressed air supply, and the hydraulic fluid that is positioned in the extended level arm 54 is moved from the extended level arm to the hydraulic fluid supply reservoir. Those skilled in the art will also appreciate that a manual lever (not shown) may be provided to move the hydraulic fluid from the hydraulic fluid supply reservoir 60 to each of the leveling arms 54.

Those having skill in the art will appreciate that a single reservoir including hydraulic fluid and compressed air may be used to accomplish the goals of the present invention. Those skilled in the art will also appreciate that the leveling arms 54 may also be provided by any other type of device that allows for the leveling arms to be moved between extended and retracted positions such as motorized screw-jacks or pneumatic cylinders, for example.

The leveling device 10 also illustratively includes a power supply 61 in communication with the controller 59 and carried by the load-carrying member 30 of the lifting apparatus 12. The power supply 61 may be provided by a battery, for example, or any other type of power source, as understood by those skilled in the art.

As mentioned above, the level sensor 58 may be a fluid level sensor. More specifically, the fluid level sensor 58 may comprise a pair of fluid reservoirs 62 in communication with one another. When the controller 59 senses a fluid level difference between the pair of opposing fluid reservoirs 62, the controller moves the leveling arms 54 between the extended and the retracted positions to thereby move the load-carrying member 30 of the lifting apparatus 12 to a level position.

The fluid level sensor 58 of the leveling device 10 may also include a switch 63 positioned between the pair of fluid reservoirs 62 and in communication with each of the fluid reservoirs. The switch 63 is moveable between opened and closed positions. The switch 63 is also in communication with the controller 59. The leveling arms 54 may be moved between the extended and retracted positions when the switch 63 is in the closed position. Those skilled in the art will appreciate that the switch 63 of the leveling device 10 may also be positioned within one of the fluid reservoirs 62 to cause movement of the leveling arms 54. Further, each fluid reservoir 62 may, for example, include a switch.

The leveling device 10 also includes a receiver 64 for receiving a signal from a remote controller 66 carried by a user U. This advantageously allows for selective movement of the leveling arms 54 between the extended and retracted positions. Accordingly, a user U may advantageously override the level sensor 58 to move the load-carrying member 30 to various angles and/or un-leveled positions. The remote controller 66 may, for example, be a simplified remote controller that may include a button corresponding to each level arm 54. More specifically, the remote controller 66 may include a first button, engagement of which moves a first one of the level arms 54 between a retracted and extended position and a second button, engagement of which moves a second one of the level arms between a retracted and extended position.

Figure 13:
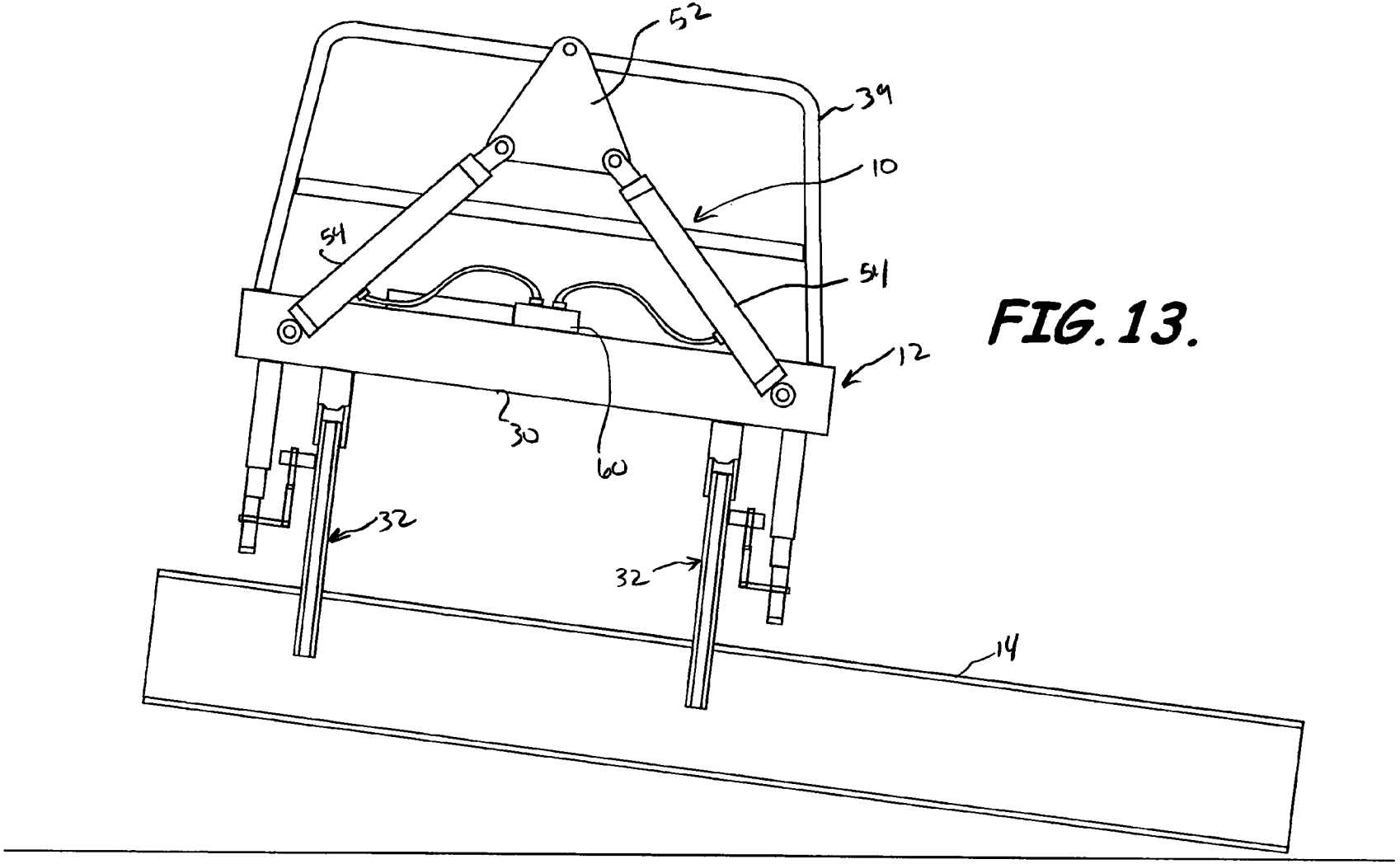
FIGS. 13 and 14 are front elevational views of a leveling device according to the present invention connected to the lifting apparatus illustrated in FIG. 6 and showing a load being lifted out of level, and the load being moved to a level position by moving a leveling arm of the leveling device.
Figure 14:
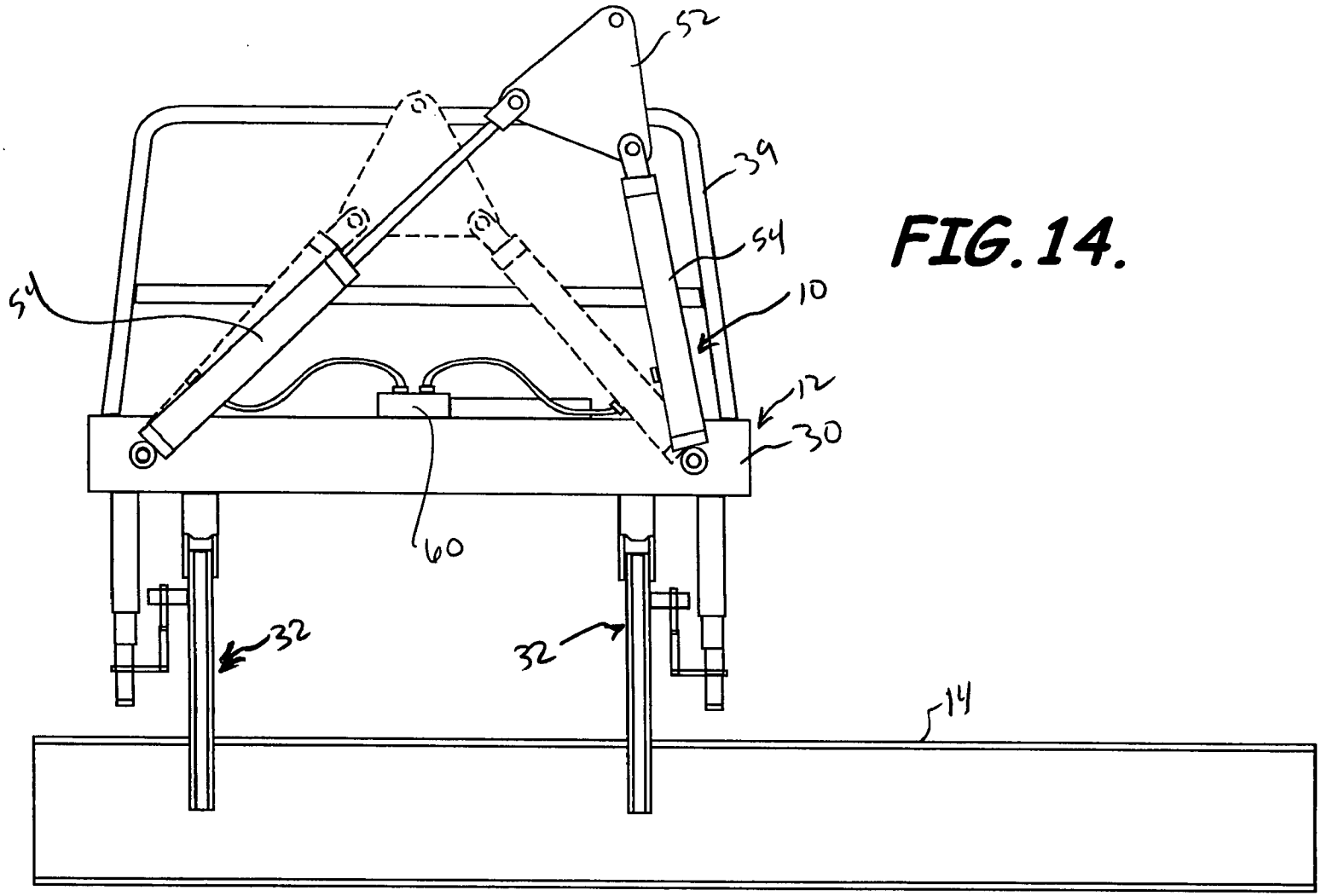

Referring now more specifically to FIGS. 13 and 14, operation of the leveling device 10 is now described in greater detail. In cases where a load 14 is lifted off-center, as illustrated in FIG. 13, for example, the load will not be level when lifted. Accordingly, and as illustrated in FIG. 14, a leveling arm 54 may be extended to bring the load 14 into a level position. Of course, it is preferable for a load 14 to be lifted with the center of gravity being positioned between the grip members 32, but those having skill in the art will appreciate that the load may be carried in any other manner, if so desired.

The leveling device 10 of the present invention advantageously allows a load 14 to be lifted in a level position without being picked up in a manner necessary for calculating the precise center of gravity of the load. In other words, when picking up a load 14, the leveling device 10 of the present invention allows the load to be lifted from any position, and thereafter brings the load into a level position by moving one or both of the leveling arms 54 between the extended and retracted positions.

Figure 15:
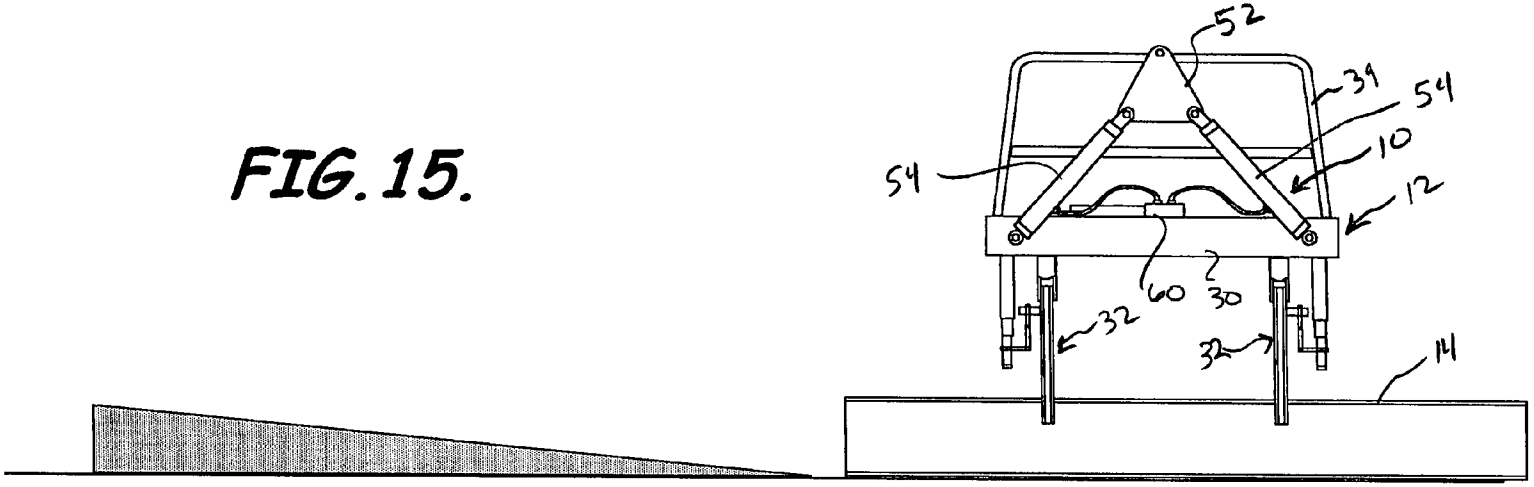
FIGS. 15 and 16 are front elevational views of the lifting apparatus illustrated in FIG. 6 lifting a load in a level position, and the leveling device according to the present invention moving the load to an angle similar to that of the surface that the load is to be positioned upon.
Figure 16:
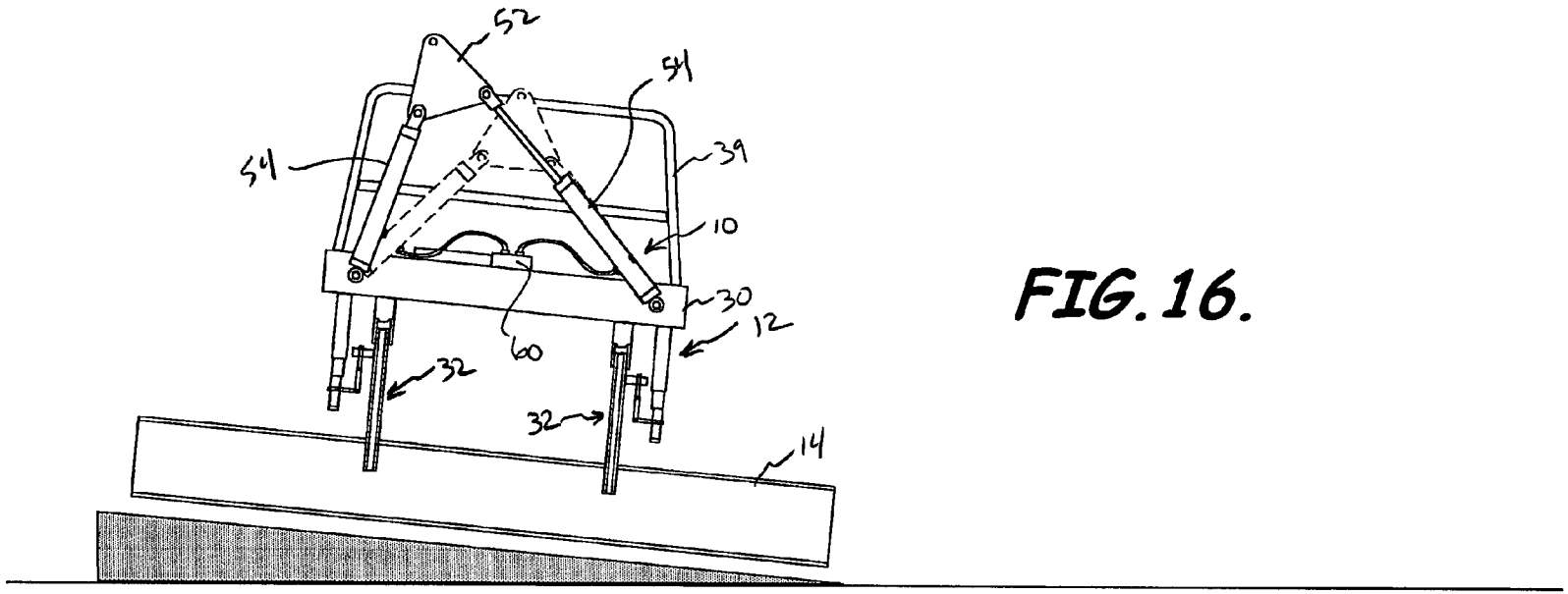

Referring now additionally to FIGS. 15 and 16, additional features of the leveling device 10 are now described in greater detail. The leveling device 10 may advantageously be used to lift a load 14 in a level position, and move the load to an angle similar to a level of the surface upon which it will be placed. More specifically, and as illustrated in FIG. 15, a load 14 may initially be resting on a level surface. Thereafter, it may become necessary to move the load 14 to a surface that is not level. Accordingly, the leveling device 10 of the present invention allows a user U to move one or both of the leveling arms 54 between the extended and retracted positions to thereby move the load 14 into a position matching the slope of the surface, as illustrated, for example, in FIG. 16.

Figure 17:
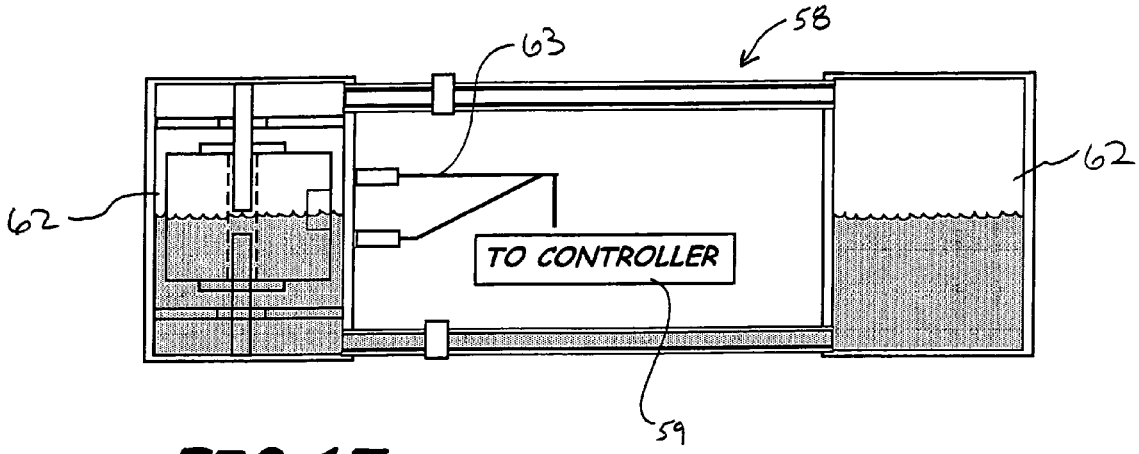
FIG. 17 is a schematic view of a fluid level sensor of the leveling device according to the present invention when a load-carrying member of the lifting apparatus is in a level position.
Figure 17A:
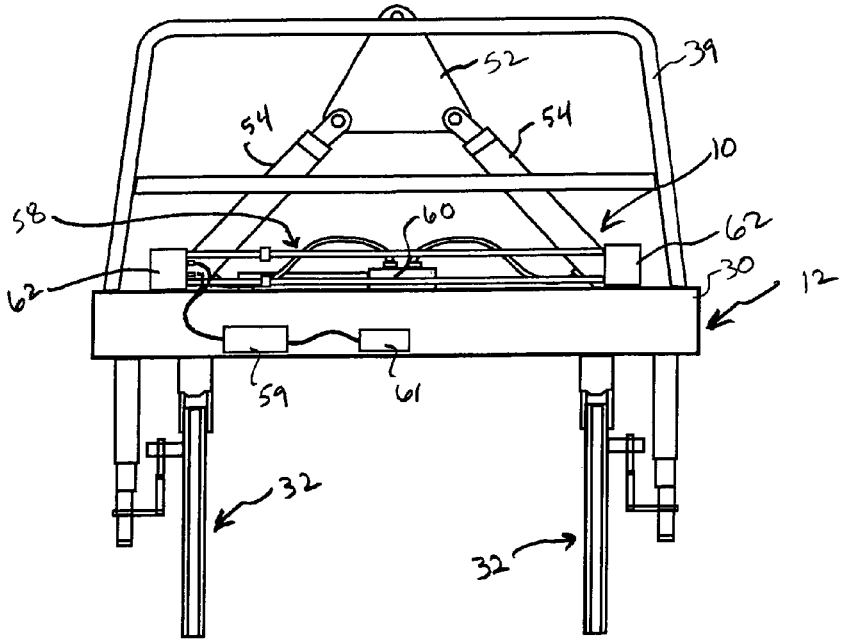
FIG. 17A is a front elevational view of the leveling device according to the present invention connected to the lifting apparatus when the load-carrying member is in a level position, as indicated by the level sensor illustrated in FIG. 17.
Figure 18:
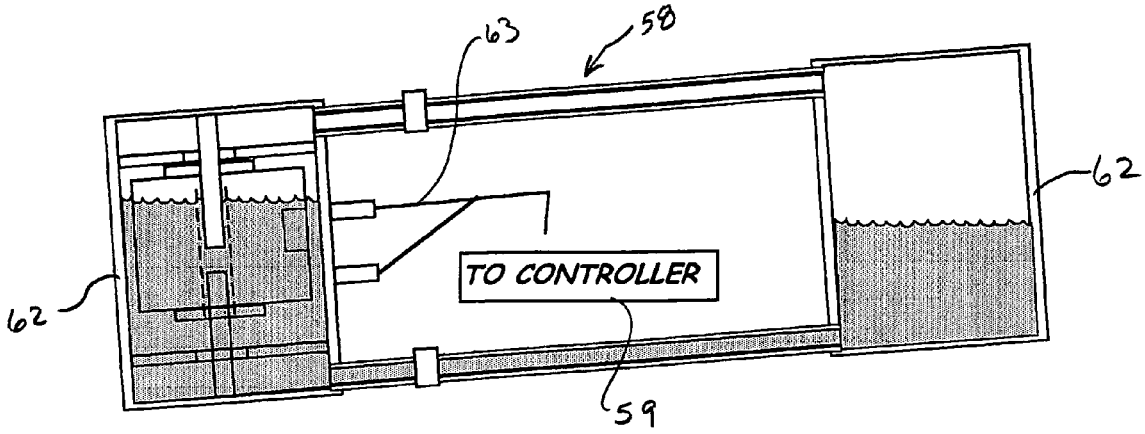
FIG. 18 is a schematic view of a fluid level sensor of the leveling device according to the present invention when the load-carrying member is not in a level position.
Figure 18A:
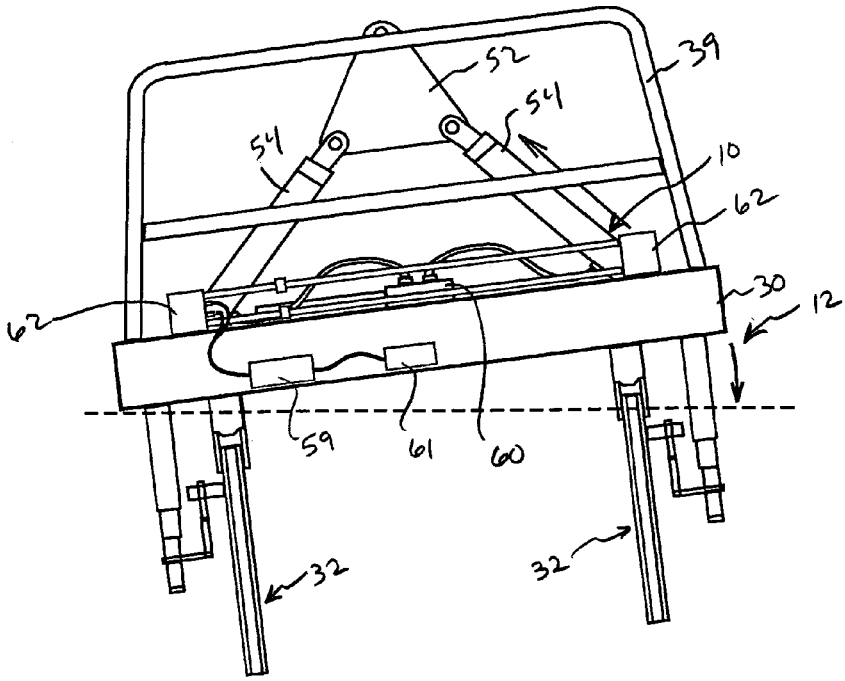
FIG. 18A is a front elevational view of the leveling device according to the present invention connected to the lifting apparatus when the load-carrying member is in an un-level position, as indicated by the level sensor illustrated in FIG. 18.
Figure 19:
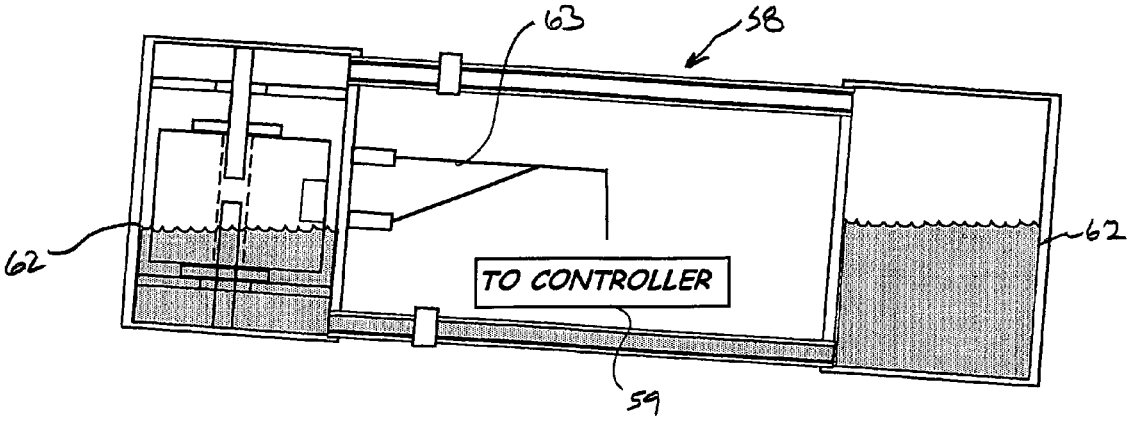
FIG. 19 is a schematic view of a fluid level sensor of the leveling device according to the present invention when the load-carrying member is not in a level position.
Figure 19A:
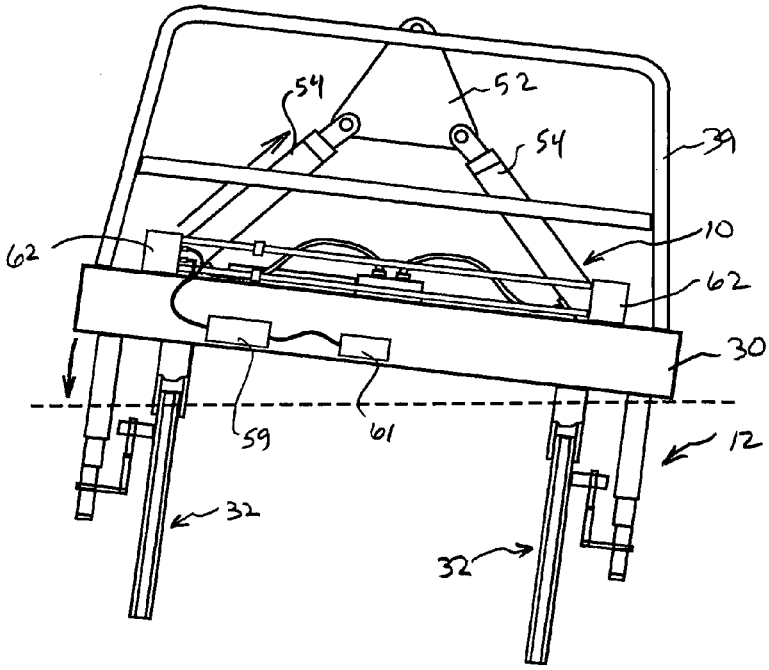
FIG. 19A is a front elevational view of the leveling device according to the present invention connected to the lifting apparatus when the load-carrying member is in an un-level position, as indicated by the level sensor illustrated in FIG. 19.

Referring now additionally to FIGS. 17-19A, additional aspects of the level sensor 58 are now described in greater detail. More specifically, the level sensor 58 of the leveling device 10 is illustrated in FIGS. 17 and 17A when the load-carrying member 30 of the lifting apparatus 12 is in a level position. Fluid in each of the fluid reservoirs 62 of the level sensor 58 is at approximately equal levels when the load-carrying member 30 of the lifting apparatus 12 is in a level position.

As illustrated in FIGS. 18-18A and 19-19A, however, when the load-carrying member 30 of the lifting apparatus 12 is not in a level position, the fluid in each of the fluid reservoirs 62 of the level sensor 58 is at different levels. Upon sensing a difference in the fluid levels of the fluid reservoirs 62, the switch 63 may be activated causing the controller 59 to move one or both of the leveling arms 54 between the extended and retracted positions to thereby bring the load-carrying member 30 of the lifting apparatus 12 into a level position. After the load-carrying member 30 of the lifting apparatus 12 is moved to the level position, the load 14 being carried by the lifting apparatus should be in a level position.

Of course, such operation assumes that the load 14 being lifted and leveled by the lifting apparatus 12 and the leveling device 10 is parallel to the load carrying member 30. In some cases, however, the load 14 may be an oblong load, such as a boat. As perhaps best illustrated in FIG. 20, when carrying such a load 14, it may be necessary to manually move the level arms 54 between the extended and retracted positions. More specifically, the load 14 may be moved to level positions even if the load carrying member 30 is not in a level position.

Combined use of the leveling device 10, the lifting apparatus 12, and the beam turning device 16 are now described. More specifically, and as described above, the beam turning device 16 may be used to move a structural steel member 14 from a horizontal position to a vertical position. After the structural steel member 14 has been moved from the horizontal position to the vertical position, the lower hook member 20, the upper hook member 22 and the chain 18 of the beam turning device 16 may be positioned in the holster 26 for storage. Thereafter, the lifting apparatus 12 may be lowered over the upper flange of the structural steel member 14. After the grip members 32 of the lifting apparatus 12 have been positioned over the flange of the structural steel member 14, the contact members 38 may be moved to the engaged position by movement of the pivot engagement member 40 from the disengaged to the engaged position. Thereafter, elevation of the lifting apparatus 12 causes the structural steel member 14 to be elevated.

Upon lifting of the structural steel member 14 by the lifting apparatus 12, the level sensor 58 of the leveling device 10 senses whether the load-carrying member 30 of the lifting apparatus is in a level position. Upon determination that the load-carrying member 30 of the lifting apparatus 12 is not in a level position, the controller 59 of the level sensor 58 causes the leveling arms 54 to be moved between extended and retracted positions to thereby bring the load-carrying member of the lifting apparatus into a level position.

After the structural steel member 14 has been moved to the desired position, the structural steel member may be lowered to rest upon the surface. Thereafter, the contact members 38 may be moved to the disengaged position by movement of the pivot engagement member 44 from the engaged to the disengaged position. Elevation of the lifting apparatus 12 causes the grip members 32 to disengage from the structural steel member 14.

A method aspect of the invention is directed to leveling a load 14 being lifted by a lifting apparatus 12. The method may comprise sensing whether the load-carrying member 30 of the lifting apparatus 12 is in a level position. The method may also comprise extending the leveling arms 54 of the leveling device 10 between extended and retracted positions responsive to sensing the load-carrying member 30 being out of level.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A leveling device for use with a lifting apparatus including a load-carrying member, the leveling device comprising:

a level arm-carrying member including a connection member adjacent a top portion thereof for connection to a crane;

a pair of leveling arms, each having a first end pivotally connected to said level arm-carrying member adjacent a bottom portion thereof, and a second end connected to the load-carrying member, each leveling arm being independently moveable between extended and retracted positions;

a level sensor carried by the load-carrying member and in communication with said leveling arms to sense whether the load-carrying member is level; and a controller in communication with said level sensor to move at least one of said leveling arms between the extended and retracted positions responsive to said level sensor sensing said load-carrying member being out of level.

2. A leveling device according to claim 1 wherein said leveling arms are hydraulic leveling arms.

3. A leveling device according to claim 2 further comprising a hydraulic fluid supply reservoir carried by the load-carrying member and in communication with said hydraulic leveling arms.

4. A leveling device according to claim 1 further comprising a power supply in communication with said controller and carried by the load-carrying member.

5. A leveling device according to claim 1 wherein said level sensor is at least one of a fluid level sensor and an electronic level sensor.

6. A leveling device according to claim 5 wherein said fluid level sensor comprises a pair of fluid reservoirs in communication with one another; wherein said controller senses a fluid level difference between the pair of opposing fluid reservoirs; and wherein said controller moves at least one of said leveling arms between the extended and retracted positions responsive to sensing the fluid level difference in the pair of opposing fluid reservoirs.

7. A leveling device according to claim 6 wherein said fluid level sensor further comprises at least one switch in communication with each of said fluid reservoirs, said at least one switch being moveable between opened and closed positions, said controller moving at least one of said leveling arms between the extended and retracted positions when said switch is in the closed position.

8. A leveling device according to claim 1 further comprising at least one receiver for receiving a signal from a remote controller carried by a user for selectively moving at least one of said leveling arms between the extended and retracted positions.

9. A leveling device for a lifting apparatus including a load-carrying member, the leveling device comprising:

a level arm-carrying member including a connection member adjacent a top portion thereof for pivotal connection to a crane;

a pair of hydraulic leveling arms having a first end connected to a base portion of said level arm-carrying member, and a second end connected to the load-carrying member, each leveling arm being independently moveable between extended and retracted positions;

a level sensor carried by the load-carrying member and in communication with each of said leveling arms to sense whether the load-carrying member is level;

a controller in communication with said level sensor to move at least one of said leveling arms between the extended and retracted positions responsive to said level sensor sensing the load-carrying member being out of level; and a power supply in communication with said controller and carried by the load-carrying member.

10. A leveling device according to claim 9 further comprising a hydraulic fluid supply reservoir carried by said load-carrying member and in communication with said hydraulic leveling arms.

11. A leveling device according to claim 9 wherein said level sensor is at least one of a fluid level sensor and an electronic level sensor.

12. A leveling device according to claim 11 wherein said fluid level sensor comprises a pair of fluid reservoirs in communication with one another; wherein said controller senses a fluid level difference between the pair of opposing fluid reservoirs; and wherein said controller moves at least one of said leveling arms responsive to sensing the fluid level difference in said opposing pair of fluid reservoirs.

13. A leveling device according to claim 12 wherein said fluid level sensor further comprises at least one switch in communication with each of said fluid reservoirs, said at least one switch being moveable between opened and closed positions, said controller moving at least one of said leveling arms between the extended and retracted positions when said switch is in the closed position.

14. A leveling device according to claim 9 further comprising at least one receiver for receiving a signal from a remote controller carried by a user for selectively moving at least one of said leveling arms between the extended and retracted positions.

15. A method for using a leveling device to level a load being lifted by a lifting apparatus including a load-carrying member, the leveling device comprising a level arm carrying member and a pair of independently moveable leveling arms pivotally connected between the level arm carrying member and the load-carrying member, the method comprising:

sensing whether the load-carrying member is in a level position using a level sensor carried by the load-carrying member and in communication with each of the pair of independently leveling arms; and extending at least one of the pair of independently moveable leveling arms between extended and retracted positions responsive to the level sensor sensing the load-carrying member being out of level to bring the load-carrying member into a level position when carrying the load.

16. A method according to claim 15 wherein the pair of leveling arms is at least one hydraulic leveling arm.

17. A method according to claim 16 wherein at least one of the hydraulic leveling arms is in communication with at least one hydraulic fluid supply reservoir.

18. A method according to claim 15 wherein sensing whether the load-carrying member is in a level position comprises using at least one of a fluid level sensor and an electronic level sensor to sense whether the load-carrying member is in a level position.

19. A method according to claim 18 wherein the fluid level sensor comprises at least one pair of fluid reservoirs in communication with one another; wherein a controller senses a fluid level difference between the pair of opposing fluid reservoirs; and wherein the controller moves the at least one leveling arm between the extended and the retracted positions responsive to sensing the fluid level difference in the opposing fluid reservoirs.

20. A method according to claim 15 further comprising selectively moving at least one of the leveling arms between the extended and retracted positions responsive to a signal transmitted from a remote controller carried by a user.

* * * * *